US005785224A

United States Patent [19]

Nowakowski

[11] Patent Number: 5,785,224

[45] Date of Patent: Jul. 28, 1998

[54] INSERTING APPARATUS AND METHOD USING A SNAP-AND-BURST TECHNIQUE

[75] Inventor: Anthony J. Nowakowski, Crystal Lake, Ill.

[73] Assignee: Carol Joyce Witt, Barrington, Ill.

[21] Appl. No.: 541,603

[22] Filed: Oct. 10, 1995

[51] Int. Cl.[6] ..... B65H 35/10

[52] U.S. Cl. ..... 225/4; 225/100; 270/52.12

[58] Field of Search ..... 225/2, 4, 5, 93, 225/100; 270/52.11, 52.12, 58.33

[56] References Cited

U.S. PATENT DOCUMENTS

| | | | |
|---|---|---|---|
| 3,481,520 | 12/1969 | Pickering | 225/100 X |
| 4,069,957 | 1/1978 | Moffitt | 225/5 |
| 4,261,497 | 4/1981 | Roetter et al. | 225/100 |
| 4,577,789 | 3/1986 | Hofmann et al. | 225/100 |
| 4,851,075 | 7/1989 | Parker | 225/100 X |
| 4,982,337 | 1/1991 | Burr et al. | 225/100 X |
| 5,079,901 | 1/1992 | Kotsiopoulos | 225/100 X |
| 5,141,142 | 8/1992 | Ramsey | 225/100 X |
| 5,238,164 | 8/1993 | Freeman | 225/4 |
| 5,464,142 | 11/1995 | Mol et al. | 225/100 |
| 5,540,369 | 7/1996 | Boreali et al. | 225/100 X |

FOREIGN PATENT DOCUMENTS

| | | | |
|---|---|---|---|
| WO 83/04013 | 11/1983 | WIPO | 225/100 |

*Primary Examiner*—Clark F. Dexter
*Attorney, Agent, or Firm*—Roper & Quigg

[57] ABSTRACT

Apparatus uses a burster method to bow a continuous web of inserts and thereafter separates the forwardmost insert from the continuous web. A pair of feed rollers advances the forwardmost insert along a predetermined path toward a pair of burst rollers. Upon receipt of the forwardmost insert, the burst rollers first operate at a decreased relative speed with respect to the advancing speed of the web, thereby bowing the continuous web of inserts. The burst rollers then operate at an increased relative speed with respect to the feed rollers, thereby separating the forwardmost insert.

21 Claims, 4 Drawing Sheets

NORMAL BURSTING POSITION

MODIFIED BURSTING POSITION

INSERTING APPARATUS AND METHOD USING A SNAP-AND-BURST TECHNIQUE

FIELD OF THE INVENTION

The present invention relates to apparatus and methods for separating inserts provided in a continuous web, and more particularly, to apparatus and methods that separate the forwardmost insert from the web and position the insert at a selected location using a snap-and-burst technique.

BACKGROUND OF THE INVENTION

It is desirable to position inserts into passing containers in various commercial processing applications. In this way, various promotional materials, discount coupons, prizes and other materials may be readily packaged together with food or other items. The term "insert" will be used herein in its broadest possible sense to include any type of insert, coupon, card, sheet, receipt, warranty, premium, and three-dimensional items such as packaged that can be advantageously handled in accordance with the invention described hereinafter. Similarly, the term "container" is used in the broadest possible context to include containers such as boxes, tubs, cans, and vessels of all kinds as well as other coupon receiving means which can be advantageously used with the present invention.

One method that is known for handling promotional materials provided in a continuous web wherein successive coupons in the web are separated from each other with a perforation, or weakened web portion, is a bursting technique. This technique advantageously exerts a sufficient separating tension to the perforation located between the forwardmost coupon and the next succeeding coupon to separate the forwardmost coupon from the web at a selected time. The forwardmost coupon is thereafter placed at a desired location such as into a moving container, as explained in U.S. Pat. No. 5,079,901.

A machine made in accordance with the teachings of said '901 patent utilizes two sets of rollers, a set of feed rollers and a set of burst rollers. The feed rollers, which are driven by a feed drive mechanism, are located upstream of the burst rollers and define a feed drive bight that receives the leading edge of the forwardmost coupon in the continuous web. The burst rollers, driven by a burst drive mechanism, further define a burst drive bight. The feed rollers advance the forwardmost coupon toward the bight of the burst rollers. In one manner of operation, the feed rollers are deactuated periodically so that, upon receipt of the leading edge of the forwardmost coupon by the burst rollers, the forwardmost coupon is separated from the next coupon along the weakened web portion separating the coupons. In another manner of operation, the feed drive operates in a substantially continuous fashion at varying speeds that are substantially less than the speed of the burst drive. In both instances, the relative speed of the burst rollers is greater than that of the feed rollers so that the forwardmost coupon may be separated with a bursting action.

This known apparatus and technique, while advantageously used in many applications, has certain inherent limitations. Specifically, one embodiment shown in said '901 patent operates somewhat inefficiently since the burst rollers continuously rotate as the coupon web is supplied intermittently thereto. However, the burst rollers must be operated in this fashion for many applications in order to generate a sufficient bursting force to successfully process certain coupon and perforation types.

In other embodiments wherein the burst rollers operate in an intermittent fashion, the force imparted by the burst rollers to that portion of the web disposed between the feed rollers and the burst rollers, and particularly to the weakened portion, is limited since the coupon web is held in tension prior to a bursting operation. Accordingly, the forces are applied to the weakened web portion at a gradually increasing rate since the burst rollers must ramp up in order to effect a bursting operation. This, of course, has an adverse impact on the success rate of the machine, particularly where the separating force required is rather great.

SUMMARY OF THE INVENTION

Accordingly, a general object of the present invention is to provide an improvement over the prior art.

Similarly, an object of the present invention is to provide an apparatus and a method for using that apparatus which provides a greater impulse of energy to effect a bursting operation in comparison to known devices.

Another general object of the present invention is to provide an inserting apparatus that is compact in design, while being efficient in operation.

An additional object of the present invention is to provide an inserting apparatus which provides improved reliability in operation.

Yet another object of the present invention is to provide an inserting apparatus that provides greater delivery flexibility.

The present invention meets the foregoing and other objects with an improved inserting apparatus and method. A device according to this invention comprises a pair of opposed feed rollers coupled with a feed roller drive mechanism and a pair of burst rollers coupled with a burst roller drive mechanism. The feed rollers and burst rollers are rotated in a controlled fashion in various modes of operation to separate the forwardmost insert from a continuous string of inserts and position the separated insert at a selected location.

The feed rollers and burst rollers are operable in one mode that induces a buckle, or an arc, in a portion of a continuous web disposed between the feed rollers and the burst rollers. This technique will be referred to herein as a "snap-and-burst" technique. The buckle permits sufficient time for the burst rollers to accelerate to an increased rotational speed while engaging the forwardmost insert, thereby applying an increased impulse of energy to the continuous web portion disposed between the feed rollers and the burst rollers. This effectuates bursting of the forwardmost insert along the perforation separating that insert from the next succeeding insert in the web. One advantage of the present invention is that reduced torque is required to effectuate a bursting operation. In addition, the invention utilizes simplified sensing and control circuitry for implementing these operations.

In addition, one specific embodiment of the present invention permits operation at increased speeds due to the use of servo motors and the reduction in torque requirements for the burst roller drive mechanism. Moreover, the system permits greater delivery flexibility with a continuously variable burst speed.

Still another aspect of the present invention is the provision for monitoring the amount of force required to generate a bursting operation. This may be implemented, for example, by monitoring the current drawn by the drive mechanism that operates the burst rollers. In this mode, the invention provides appropriate control signals to initiate a snap-and-burst operation when sensed signals corresponding to the force required to effectuate a burst exceed a threshold value. Otherwise, the invention operates in a second mode wherein the web supply is advanced without the induction of a buckle or arc in the web portion disposed between the feed rollers and the burst rollers. This particular feature of the invention may, of course, be implemented by other sensing techniques.

Other objects and advantages will become apparent from the following detailed description when taken in conjunction with attached drawings. Moreover, while the invention will be described in connection with certain preferred embodiments, it is not intended that the invention be limited to those specific embodiments but rather that it be accorded a scope commensurate with the appended claims.

It should be understood that the drawings are not necessarily to scale. In certain instances, details which are not necessary for an understanding of the present invention or which render other details difficult to perceive may have been omitted.

DETAILED DESCRIPTION OF THE PREFERRED EMBODIMENTS

Generally, the present invention provides an improved bursting assembly and method for reliably separating inserts provided in a continuous web at a relatively high rate. The present invention relates to improvements to the inventions described in U.S. Pat. No. 5,079,901 and U.S. patent application Ser. No. 370,779, filed Dec. 23, 1994, which is a continuation of application Ser. No. 010,759, filed Jan. 29, 1993. The subject matter of each of these applications and patent is incorporated herein by reference. A device according to the present invention receives a continuous web of inserts and, upon receipt of a first control signal, operates to move the forwardmost insert in a controlled fashion in a feeding operation. In a bursting operation, the apparatus controls the operation of the burst and feed rollers first to buckle or arc a selected portion of the web supply disposed between the burst rollers and the feed rollers, and then to snap the forwardmost insert away from the continuous web upon receipt of a second control signal.

The device of this invention is intended to be integrated into a full service processing system, typically supplying successive inserts into the containers at a processing stage where the containers have been formed, may or may not yet be filled, and have not yet been closed. By way of example, the device of this invention may be adapted to supply inserts to bags of snack food containers, cereal boxes, bread sacks, or any other container using the teachings described herein. In addition, the invention may be used to supply seasoning pouches, condiments and other samples to the containers.

Figure 1:
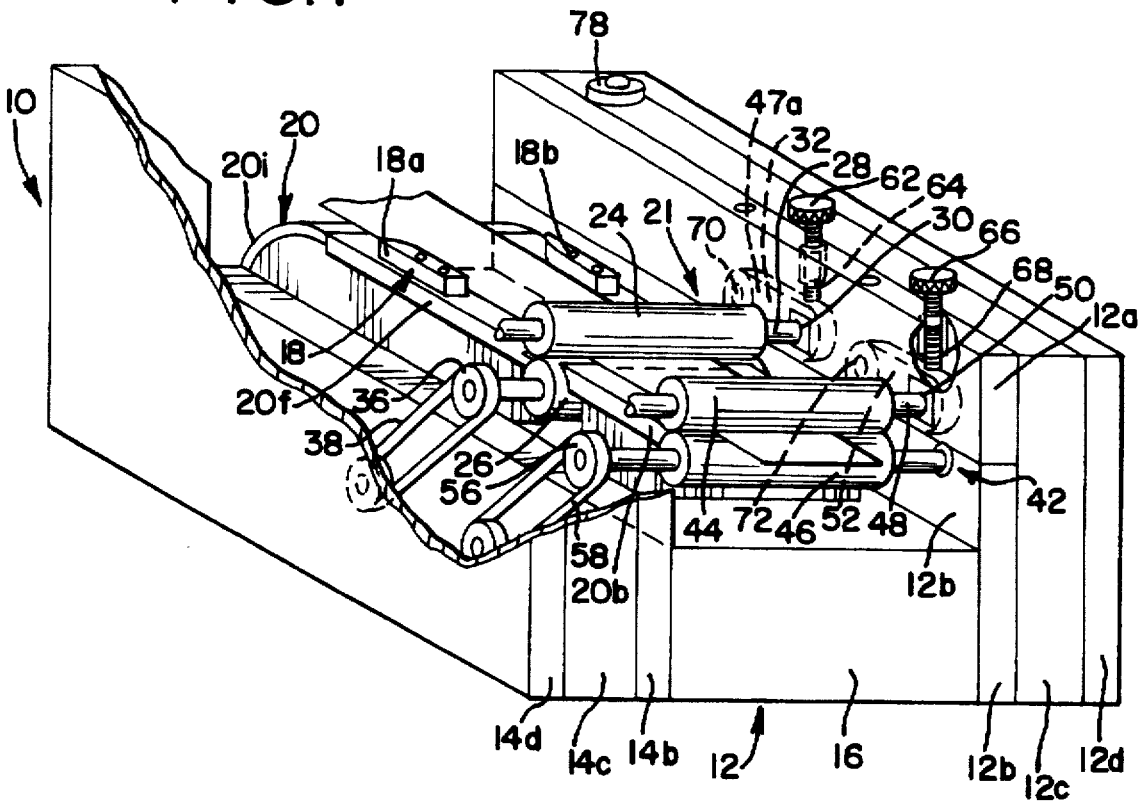
FIG. 1 is a perspective view of an illustrative embodiment of inserting apparatus embodying the principles of this invention.

FIG. 1 illustrates an inserting assembly 10 according to this invention. The inserting assembly 10 comprises a housing 12 with various housing components including opposed idler frame pieces 12*a*, 14*a* (see FIGS. 1 and 2). The idler frame pieces 12*a*, 14*a* are each subtended by a side frame piece 12*b*, 14*b* in abutting relation with the respective idler frame pieces. A pair of opposed side cover pieces 12*d*, 14*d* are spaced outwardly from the respective idler frame and side frame pieces, each of which are respectively separated therefrom by opposed side cover frame pieces 12*c*, 14*c*. A motor housing 16 is spaced inwardly from the side frame pieces 12*b*, 14*b*. The side cover pieces 12*d*, 14*d* are readily removable in order to gain ready access to the internal components of the inserting assembly 10.

The housing 12 may be mounted on a pedestal (not shown) or other suitable means adapted for pivotal and/or rotational movement to locate the inserting assembly 10 in a desired orientation, such as, toward a processing line spaced proximate to a stream of moving containers. The containers are typically provided along a conveyor system or other handling system as would be understood by those skilled in the art.

A continuous web supply of inserts is typically provided to the inserting assembly 10 in a fan-folded or a traverse fan-folded format as will be understood by those skilled in the art. The web supply may also be packaged in a continuous circular reel, rotatably mounted via a support (not shown) proximate the assembly 10. It is contemplated that the invention may be utilized in conjunction with any number of insert types. As an example, the web supply may be a continuous supply of paperboard or cardboard coupons physically connected to each other but connected to each other by perforations or otherwise connected to each other by weakened web portions which extend transversely of the web. In addition, the web supply may be a packaged premium or other insert comprising small prizes, condiments or the like that are contained in plastic wrappers or pouches and are successively connected together by separable portions.

The assembly 10 preferably includes an infeed guide 18 which channels the web for downstream processing. The infeed guide 18 includes a pair of opposed channeling brackets 18*a*, 18*b* which are placed at opposite sides of the insert path. The brackets 18*a*, 18*b* are mounted to a supply platform 20 having an inclined section 20*i*, a relatively planar feeding section 20*f*, and a relatively planar bursting section 20*b* disposed between a feed roller subassembly 21 and a burst roller subassembly 42. This arrangement maintains the proper web flow as the web is processed by the inserting assembly 10.

The assembly 10 may alternatively include opposed tensioning rolls rotatably mounted to the housing 12. In this regard, an upper tensioning roll may be provided as an idler roll and an opposed lower tensioning roll may be connected to an adjustable resistance device of the type known to those skilled in the art thus providing tension between tensioning rolls to ensure uniformity in the web and to minimize bending or folding of the web during further processing operations.

Figure 2:
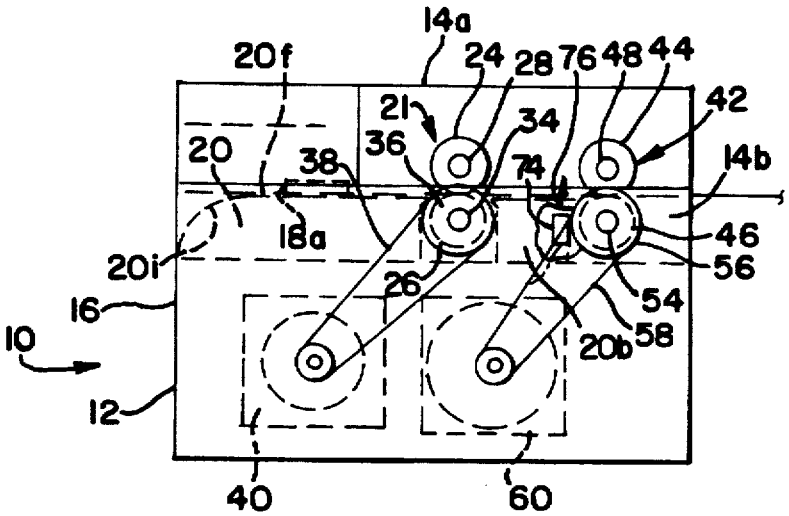
FIG. 2 is a side view of the inserting apparatus of FIG. 1.

FIGS. 1 and 2 illustrate a feed roller subassembly 21 including an upper feed roller 24 and a lower feed roller 26. As best seen in FIG. 1, the upper feed roller 24 is mounted to a rotary shaft 28. The shaft 28 is placed within a suitable bearing 30 disposed on a first idler pivot arm 32 and is freely rotatable relative thereto. The lower feed roller 26 is mounted to a drive shaft 34, and substantially traverses, and in most applications extends beyond, the width of coupons to be processed. At one end, the lower feed roller drive shaft 34 is mounted within a suitable bearing disposed in the side frame piece 12b and is freely rotatable relative to the side frame 12b. A pulley 36 is attached to the opposed end of shaft 34 and is coupled via a belt 38 to a servo drive motor 40 (see FIG. 2). The feed roller subassembly 21 operates in a controlled fashion to receive the insert supply in a nip formed between the upper and lower feed rollers 24, 26. Thus, the feed rollers 24, 26 define a bight which receives the leading edge of the forwardmost insert in the continuous web.

FIGS. 1 and 2 also show a burst roller subassembly 42 including an upper burst roller 44 and a lower burst roller 46. As with the upper feed roller 24, the upper burst roller 44 is mounted to a rotary shaft 48. The shaft 48 is disposed within a suitable bearing 50 disposed on a second idler pivot arm 52. The lower feed roller 46 is mounted to a rotary drive shaft 54. At one end, the lower feed roller drive shaft 54 is mounted within a suitable bearing disposed in the side frame piece 12b and is freely rotatable relative to the side frame 12b. A pulley 56 is attached to the opposed end of shaft 54 and is coupled via a belt 58 to a servo drive motor 60 (see FIG. 2). The burst rollers 44, 46 define a bight which receives the leading edge of the forwardmost insert in the continuous web.

Both the feed rollers 24, 26 and burst rollers 44, 46 may be fabricated from of a polyurethane material for increased durability. Alternatively, the rollers may be fabricated from rubber to provide increased frictional properties due to moisture build-up on the rollers. The use of rubber rollers, therefore, is advantageous in applications where the inserts being handled frequently become wet or cause slight amounts of leakage.

The vertical spacing between the upper and lower feed rollers 24, 26 is adjusted via a construction including the first idler pivot arm 32, an adjustment screw 62 threaded within the idler frame piece 12a, and a compression spring 64 disposed between the first idler pivot arm 32 and the adjustment screw 62. Likewise, the vertical spacing between the upper and lower burst rollers 44, 46 is adjusted with the second idler pivot arm 52, an adjustment screw 66, also threaded within the idler frame piece 12a, and a compression spring 68 that is similarly disposed between the second idler pivot arm 52 and adjustment screw 66.

The idler pivot arms 32, 52 are rotatably mounted to the idler frame piece 12a with pivots 70, 72 so that the upper feed roller and upper burst roller may be moved relative to the lower feed roller and lower burst roller, respectively. Thus, adjustment of screws 62, 66 provides an adjustment of the amount of downward force applied to the pivot arms 32, 52. In this way, the adjustment screws 62, 66 are utilized to set the amount of nip force in both the feed rollers and the burst rollers. It should be understood that this same arrangement is also disposed on the opposite ends of the upper feed roller and upper burst roller as well. In practice, the idler pivot arms 32, 52 can be adjusted within a range on the order of one-quarter of an inch in order to set the proper gripping tension while permitting the rollers to process inserts having varying cross sectional thicknesses.

In an alternative embodiment, the upper feed roller may be replaced by a pair of feed rollers axially spaced from each other. Likewise, the upper burst roller may also be replaced with a pair of axially spaced rollers. Inasmuch as the axial spacing of the upper feed rolls and the upper burst rolls is readily adjustable, an insert having a raised center portion and lateral sides which may be substantially flattened, such as prizes and the like contained in a wrapper, may be handled by engagement of the side portions of the insert in the nip formed between the spaced upper feed rollers and the lower feed roller on lateral sides of the insert and also between the spaced upper burst rollers and the lower burst roller. In this manner, small prizes or other three-dimensional premiums may be handled.

FIGS. 2 and 3 also show a photoelectric sensor or photosensor 74 positioned relative to an insert dispensing location disposed within the bursting platform section 20b between the feed roller subassembly 21 and the burst roller subassembly 42. As described in greater detail below, the leading edge of an insert intercepts the light beam emitted by the photoelectric sensor 74 (denoted by arrow 76). In response, the photoelectric sensor 74 provides a sensing signal indicative of the detection of an insert registered between the feed roller subassembly 21 and the burst roller subassembly 42. In other instances, the photosensor 74 detects whether the web supply is disposed between the feed rollers and the burst rollers and provides signals indicative of the presence or the absence of the web supply.

The inserting assembly 10 uses two servo motors, a feed drive servo motor 40 and a burst drive servo motor 60, each of which is disposed within the motor housing 16. As noted above, servo motor 40 is coupled with the lower feed roller 26 while servo motor 60 is coupled with the lower burst roller 46. In the preferred embodiment, the servo motors are type MPM891 FRME-P of reduced size, manufactured by Custom Servo Motors, Inc. The two motors 40, 60 are independently controlled to eliminate the need for any clutches or other mechanical coupling or decoupling means. Further, the use of independently operated servo motors 40, 60 eliminates the need for additional pulleys and belts. The coupon inserting assembly 10 is stopped, in emergency situations, via an emergency stop button 78 located on the housing.

Figure 3A:
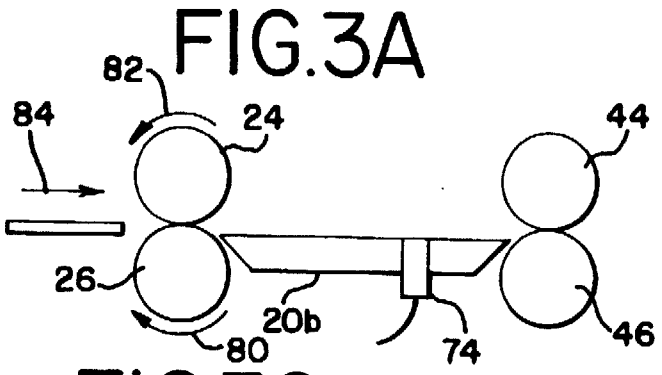
FIG. 3A–FIG. 3F are schematic diagrams that illustrate the sequential operations of the inserting apparatus shown in FIG. 1.
Figure 3B:
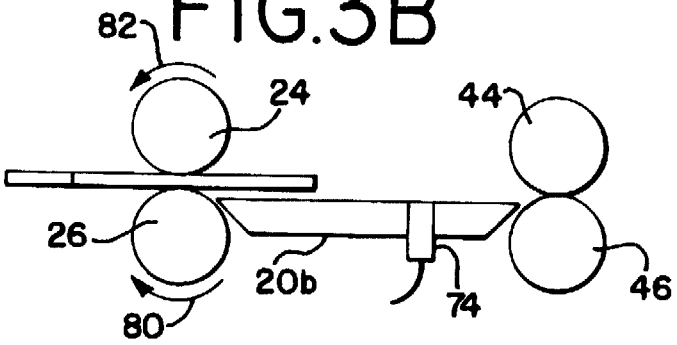

The servo motors 40, 60 operate in response to control signals provided by an electronic controller (see FIG. 4) to rotate the feed rollers and the burst rollers in a controlled fashion so that the appropriate sequences of operation may be performed on the web supply, as shown schematically in FIG. 3A through FIG. 3F. FIG. 3A illustrates the lower feed roller 26 being rotated (under control of the feed drive servo motor 40) in the direction of arrow 80. Inasmuch as the upper feed roller 24 is an idler roller, it is rotated in the opposite direction (denoted by arrow 82) so that when the web supply is drawn into the bight between feed rollers, it is moved downstream in the direction denoted by arrow 84. As the feed rollers 24, 26 continue to rotate, the web is advanced toward the burst rollers 44, 46 and the web detecting photosensor 74 as shown in FIG. 3B.

Figure 3C:
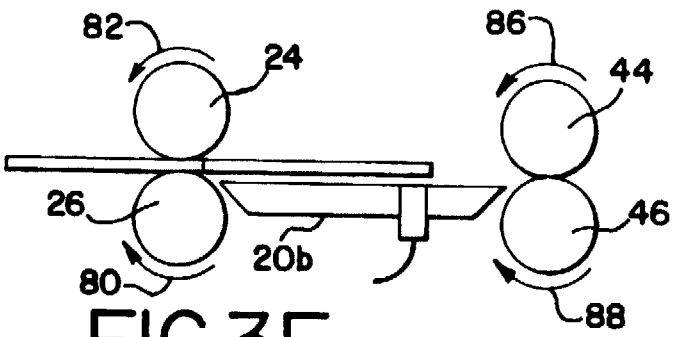

The photoelectric sensor 74 thereafter senses the leading edge of the forwardmost insert as it passes a selected location disposed between the feed rollers 24, 26 and the burst rollers 44, 46 as shown in FIG. 3C. The sensor 74 supplies a sensing signal to the electronic controller 90 indicative of the detection of the leading edge of the forwardmost insert at the sensing location. As discussed in more detail below, the electronic controller 90 then provides appropriate control signals to activate the servo burst drive motor 60, thereby rotating the burst rollers 44, 46 in the directions denoted by arrows 86, 88 respectively as seen in FIG. 3C. In this loading operation, the feed rollers 24, 26 and the burst rollers 44, 46 are preferably rotated at the same speeds.

The continuous web is advanced until the forwardmost insert is received in a nip formed between the burst rollers 44, 46 and thereafter moved to the position shown in FIG.

3D. This position is a typical bursting position inasmuch as the continuous web is retained in tension between the feed rollers 24, 26 and the burst rollers 44, 46. Both the feed rollers 24, 26 and the burst rollers 38, 44 are deactuated when the web supply is moved to a position where the perforation separating the forwardmost insert from the next succeeding insert is disposed between the feed rollers 24, 26 and the burst rollers 44, 46, preferably at an upstream location with respect to the insert sensor 74. As described in greater detail below, the inserting apparatus 10 awaits a signal related to the time in which the forwardmost insert will be separated from the web so that it may be dispensed into a moving container as the container passes a dispensing location.

Figure 3D:
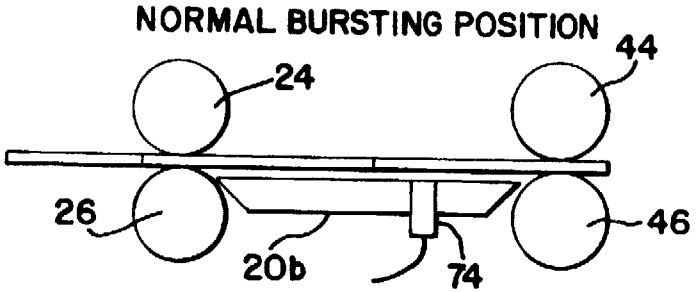

In many applications, the burst rollers 44, 46 may be accelerated when the web is moved to the position shown in FIG. 3D to provide a sufficient tension force to the web such that the forwardmost insert is separated at the weakened web portion or perforation. For example, many inserts fabricated from elastomeric pouches or as three-dimensional premiums may be readily separated at a fairly low failure rate. However, for other applications, such as the case where the inserts are fabricated from paper or cardboard, it is necessary to apply an increased tension force to the web supply in order to effect a reliable bursting operation. Accordingly, a higher failure rate results.

Figure 3E:
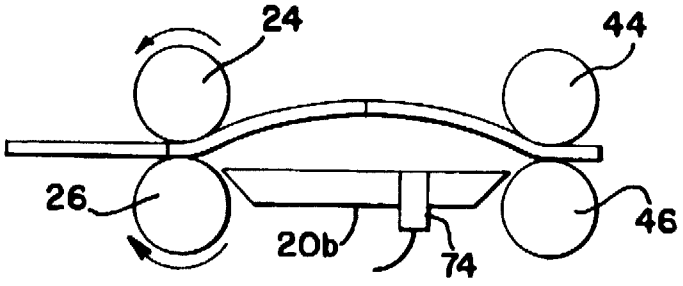

The present invention overcomes this potentially problematic situation by operating in a mode that applies a greater impulse of energy to effect a bursting operation. As shown in FIG. 3E, the web supply is advanced from the normal bursting position (shown in FIG. 3D) by actuating the feed rollers so that they are rotated in the directions shown by arrows 80, 82 at a greater relative speed than the burst rollers 44, 46. In the exemplary embodiment shown in FIG. 3E, the burst rollers 44, 46 are deactuated while the feed rollers 24, 26 are actuated. The web then begins to buckle or arc with the perforation separating the forwardmost insert from the next succeeding insert preferably disposed proximate to the apex of the arc. The perforation, however, is disposed upstream from the photosensor 74, as shown in FIG. 3E, so that the leading edge of the next coupon to be processed can be detected as it is moved past the photosensor 74.

Those skilled in the art will appreciate that the web may alternatively be buckled or arced by either (1) increasing the speed of the feed rollers 24, 26 while maintaining, decreasing, or even reversing rotational speed of the burst rollers 44, 46; or (2) maintaining the speed of the feed rollers 24 and 26 constant while decreasing, halting or reversing the rotation of the burst rollers 44, 46.

Figure 3F:
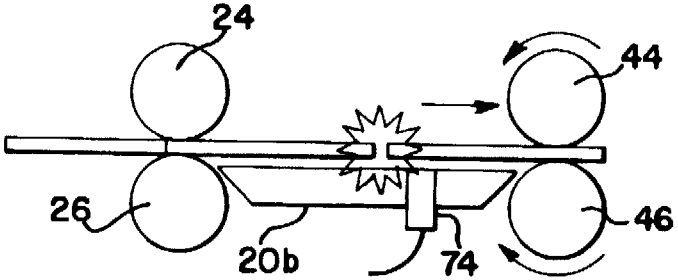

After the web moved to the position shown in FIG. 3E, the feed rollers 24, 26 are deactuated. At the appropriate time, the burst rollers 44, 46 are rapidly accelerated as shown in FIG. 3F. Such rapid acceleration generates a snapping or whipping action of the web thereby separating the forwardmost insert from the continuous web along the perforation. This action greatly reduces the amount of torque required by the burst servo motor to effect a burst. For example, the present invention provides on the order of an 80 percent reduction in torque for processing a string of paperboard coupons as compared to conventional bursting techniques. Moreover the present invention permits reliable bursting of other coupon types having high relatively tensile strength in the weakened web portions of the web. Alternative ways to snap the web include (1) increasing the speed of the burst rollers 44, 46 while maintaining, decreasing, or reversing the rotational speed of the feed rollers 24, 26; or (2) maintaining the speed of the burst rollers 44, 46 constant while decreasing, halting or reversing the rotation of the feed rollers 24, 26.

There are several variables which effect the operation of the inserting assembly 10. One variable is the relative position of the perforation with respect to the feed rollers 24, 26 and burst rollers 44, 46. The perforation in the web should remain upstream from the photosensor 24 during the bursting operation. When the web buckles, the position of the perforation may be equidistant from the burst rollers 44, 46 and the feed rollers 24, 26, positioned closer to the feed rollers 24, 26, or positioned closer to the burst rollers 44, 46.

Second, the amount of buckling of the web determines the amount of tension force which is imparted to break the perforation. Generally, a greater force will be imparted to the web as the arc of the web is increased.

Figure 4:
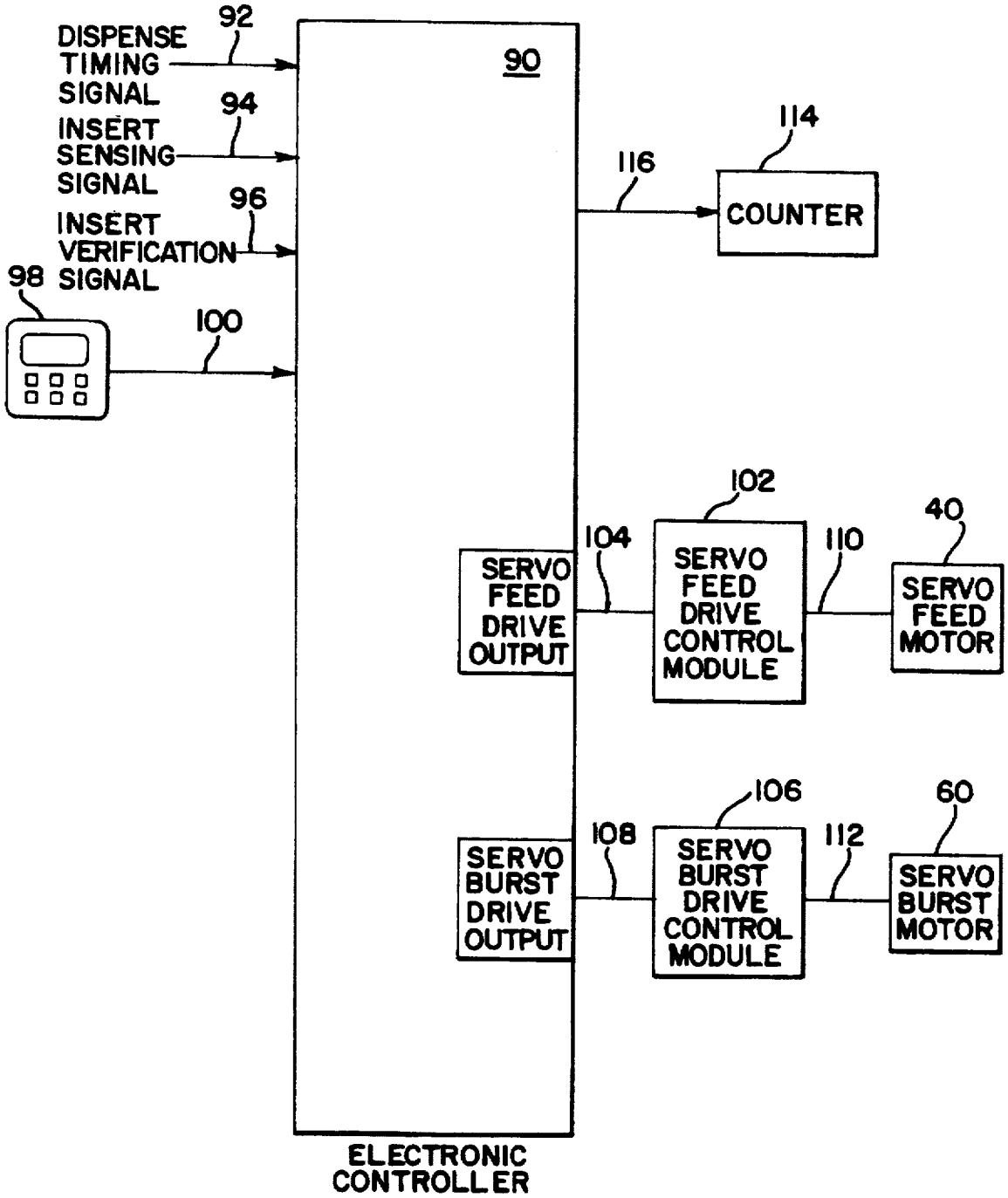
FIG. 4 is a simplified electrical block diagram illustrating suitable control circuitry for the inserting apparatus of FIG. 1.

FIG. 4 illustrates one specific control system that may be utilized in practicing this invention. The electrical circuitry described hereinafter is typically located in a housing module remote from the inserter assembly and protected by suitable isolation circuitry, as will be understood by those skilled in the art. As shown in FIG. 4, an electronic controller 90 receives an insert dispense timing signal from a container processing line sensor or other suitable timing circuitry on a line 92, an insert detect signal indicative of the detection of the leading edge of an insert or of the presence or the absence of the web supply at the sensing location by the photoelectric sensor 74 on a line 94, and an insert verification signal on a line 96.

In addition, the electronic controller 90 receives various input command signals from a hand-held terminal or pendant 98 via a line 100. These input command signals may include signals relating to an insert length preset, a total count request or other desired parameters.

In the preferred embodiment, the electronic controller 90 is a microprocessor-based controller. The electronic controller 90 operates in a logical fashion to provide output signals to a servo feed drive control module 102 on a line 104 and to a servo burst drive control module 106 on a line 108. The servo feed drive control module 102 and the burst drive control module 106 are preferably a Type MPA-03/06 SL, manufactured by Custom Servo Motors, Inc. The drive control modules 102, 106 operate in a known manner to provide output drive pulses to the servo feed drive motor 40 and the servo burst drive motor 60 on the lines 110, 112 respectively.

The dispense timing signal supplied on line 92 is processed to determine the appropriate time to initiate a burst operation. Optionally, coupon length preset input information, dispense delay information and other information may additionally be used to determine the appropriate time to initiate the burst operation. The dispense timing signal on line 92 may be supplied from any number of external sources including existing product line control, a photoelectric sensor arrangement for detecting passing containers, proximity detection, an encoder scheme or any other suitable source. Likewise, this signal may be used by the controller 90 to determine the rate at which to feed inserts during a feed operation. As noted above, the insert detect signal on line 94 is generated by the photoelectric sensor 74 to register the position of the leading edge of the web, and also to verify the presence or the absence of the web supply.

The insert verification signal on line 96 may optionally be employed to verify that the forwardmost insert has been successfully delivered to its target. This signal may be based on photocell detection of an exiting insert or even on a sonic sensor which detects arrival of an insert within a container.

The controller may also be implemented to maintain a count corresponding to the number of inserts contained in the web. This count is decremented upon execution of a burst sequence. In addition, the controller 90 may supply an output signal to a counter 114 on a line 116 to indicate the total number of delivered inserts.

Figure 5:
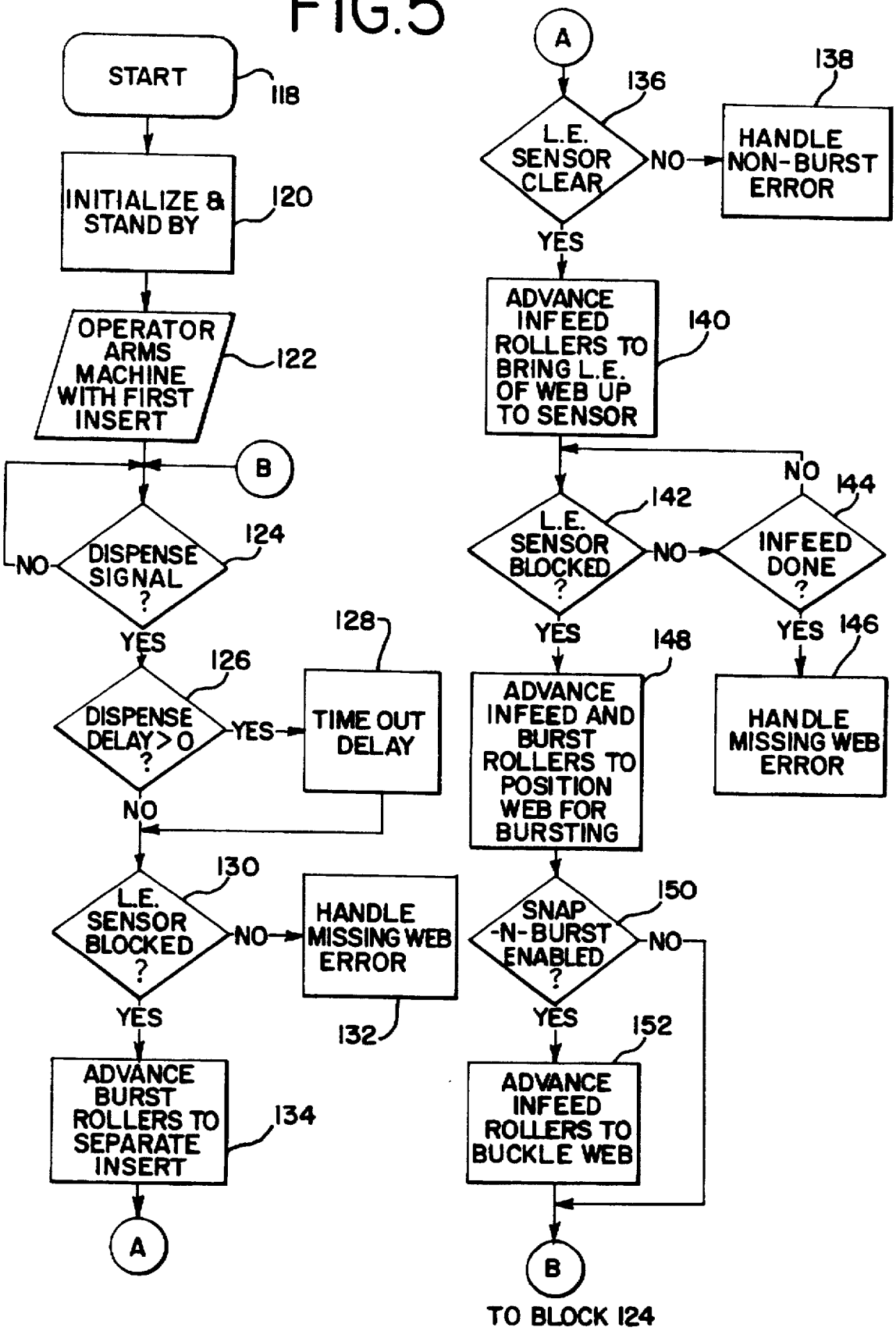
FIG. 5 is a logical flow chart illustrating a control sequence performed by the control circuitry of FIG. 4.

FIG. 5 is a logical flow chart for system operation of the inserting assembly 10 according to the present invention. As shown, the system begins at a start block 118. The system then advances to a next block 120 at which initial conditions are set. Specifically, the system initializes parameters for motion and timing calculation for delivery of an insert of a specific length at a desired rate and for a particular amount of buckling of the web before bursting, and monitoring of system inputs and outputs.

At a next block 122, the operator arms the machine with the first insert during the initial system start-up. The forwardmost insert is moved upstream of the feed rollers 24, 26 so that its trailing edge is disposed between the feed rollers 24, 26 and the burst rollers 44, 46, at a location between the feed rollers and photoelectric sensor 74. The system then advances to a decision block 124 which determines whether a dispense signal is received which corresponds to the time in which the forwardmost insert is to be separated from the continuous web and inserted at a selected location, such as, into a moving container.

If at decision block 124 the system receives the dispense signal, the system advances to a next decision block 126. The system then determines whether a delay time has been input. If yes, the system advances to a block 128 and waits the requested time interval in order to initiate a bursting operation. The system then advances to a next decision block 130. Similarly, at decision block 126, if the system determines that no delay interval has been requested, the system advances to the decision block 130.

At decision block 130, the system determines whether the insert sensor (denoted as reference numeral 74 in FIGS. 2–3A–3F) is blocked. This indicates that the insert stream is disposed between the feed rollers 24, 26 and the burst rollers 44, 46. If no, the system advances to a block 132 and makes appropriate corrective action. For example, the system may provide warning signals or a message to the pendant 98 indicating to the operator that intervention is required.

On the other hand, if at decision block 130 the system determines that the web is present at the sensing location between the feed rollers and the burst rollers, the system advances to a next block 134. The sequence of steps performed in this block corresponds to a burst operation. In particular, the electronic controller 90 provides control signals to the servo burst drive output circuit 106 (see FIG. 4). This circuit, in turn, drive the servo burst motor 60 at a sufficient rotational speed to accelerate the burst rollers 44, 46 and separate the forwardmost insert from the web. The insert is then advanced by the burst rollers to a selected location such as into a passing container.

The system then advances to a next decision block 136 and determines whether the photosensor is clear or unblocked which indicates that the forwardmost insert was successfully separated from the web. If the leading edge photosensor 74 is not clear, the system advances to a block 138 and handles the bursting error. On the other hand, if the system determines that the photosensor 74 is clear at decision block 136, the system advances to a next block 140.

At block 140, the system provides appropriate control signals to advance the web supply. The system then advances to a decision block 142 and determines whether the web supply has advanced to a position where the leading edge of the next insert has blocked the photosensor. If no, the system advances to a decision block 144 and determines whether the feeding operation has completed. If, at decision block 144, the system determines that the feeding operation has completed, the system advances to a block 146 and handles the missing web error. On the other hand, if the system determines that the feeding operation has not yet completed, the system returns to decision block 142. This operation is also shown diagrammetrically in FIG. 3B.

Once the system determines that the leading of the next insert is positioned at the coupon sensor at decision block 142, the system advances to a next block 148. At this block, the system provides appropriate control signals to advance both the feed rollers 24, 26 and the burst rollers 44, 46. This sequence generally corresponds to the sequence shown in FIGS. 3C–3D.

The system then advances to a decision block 150 and determines whether the snap and burst operation sequence is enabled. Typically, the snap and burst is enabled in one of two ways. First, the snap and burst can be enabled via a manual input to the electronic controller 90. Second, the snap and burst can be enabled automatically with the use of appropriate sensing circuitry employed to monitor the amount of current drawn by the servo burst motor 60. This sensing circuit provides signals to the electronic controller 90 indicative of the servo motor load. Depending on the amount of current drawn by the servo motor 60, the electronic controller 90 can estimate the amount of torque applied to the burst rollers 44, 46. If the amount of torque exceeds a certain amount, the electronic controller 90 automatically enables the snap and burst routine in order to lessen the amount of torque required of the servo burst motor 60, while increasing the impulse of force applied to separate the forwardmost insert.

If, at decision block 150, the system determines that the snap and burst sequence is enabled, the system advances to a next block 152. The electronic controller 90 provides control signals to advance the feed rollers 24, 26 to buckle the web when the web is disposed between the feed rollers and the burst rollers. This operation is also shown diagrammetrically in FIG. 3E. The system then returns to decision block 124 and continues.

If, at decision block 150, the system determines that the snap and burst routine is not enabled, the system returns to decision block 124 and continues. In this mode, the bursting operation is performed without buckling.

As noted above, the upper feed roller and upper burst roller arrangements are mounted to the idler frame pieces 12*a*, 14*a*, while the lower feed rollers and burst rollers are mounted to the side frame pieces 12*b*, 14*b*. Thus, the particular feed roller and burst roller configurations may be readily modified depending on the particular application simply by removing the idler frame and side frame pieces.

As set forth above, an improved snap and burst system and method of using the same has been described. Various modification as would be apparent to one of ordinary skill in the art and familiar with the teaching of this application are deemed to be within the scope of this invention.

What is claimed is:

1. A method for separating inserts from a continuous web of inserts being connected to each other by a weakened web portion with a bursting apparatus including opposed feed rollers, opposed burst rollers disposed downstream from the feed rollers, and coupon sensing means disposed at a sensing position between the feed rollers and the burst rollers, said method comprising the steps of:

(a) advancing the continuous web with the feed rollers along a coupon path toward a predetermined dispensing location, said coupon path extending between said opposed feed rollers and between said opposed burst rollers;

(b) sensing the presence of the leading edge of the forwardmost insert at the sensing position with the coupon sensing means;

(c) advancing said continuous web with both the feed rollers and the burst rollers after sensing the forwardmost insert at the sensing position until the weakened web portion connecting the forwardmost insert to the next succeeding insert is disposed between the feed rollers and the burst rollers;

(d) bowing the portion of the continuous web between the feed rollers and the burst rollers by operating the feed rollers at a greater rotational speed than that of the burst rollers; and (e) bursting the forwardmost insert from the next insert in the continuous web along the weakened web portion by operating the burst rollers at a rotational speed greater than that of the feed rollers and positioning the forwardmost insert at said predetermined dispensing location.

2. The method as defined in claim 1 wherein the coupon sensing means is a photoelectric sensor.

3. The method as defined in claim 1 wherein the weakened web portion connecting the forwardmost insert from the next succeeding insert is a perforation extending transversely across the web.

4. The method as defined in claim 1 wherein the bowing of the portion of the continuous web between the feed rollers and the burst rollers by operating the feed rollers at a greater rotational speed than that of the burst rollers is accomplished by deactuating the burst rollers and operating the feed rollers.

5. The method as defined in claim 4 wherein the bursting of the forwardmost insert by operating the burst rollers at a rotational speed greater than that of the feed rollers is accomplished by actuating the burst rollers and deactuating the feed rollers.

6. The method as defined in claim 1 wherein the bowing of the portion of the continuous web between the feed rollers and the burst rollers is accomplished by reducing the rotational speed of the burst rollers and maintaining the speed of the feed rollers.

7. The method as defined in claim 1 wherein the bowing of the portion of the continuous web between the feed rollers and the burst rollers at a greater speed than the burst rollers is accomplished by increasing the rotational speed of the feed rollers and maintaining the speed of the burst rollers.

8. The method as defined in claim 1 wherein the bowing of the portion of the continuous web between the feed rollers and the burst rollers includes increasing the rotational speed of the feed rollers and decreasing the rotational speed of the burst rollers.

9. The method as defined in claim 1 wherein the bursting of the forwardmost insert is accomplished by increasing the rotational speed of the burst rollers and maintaining the rotational speed of the feed rollers.

10. The method as defined in claim 1 wherein the burst rollers are operating at a given speed and the bursting of the forwardmost insert is accomplished by decreasing the rotational speed of the feed rollers and maintaining the rotational speed of the burst rollers.

11. The method as defined in claim 1 wherein the bursting of the forwardmost insert is accomplished by increasing the rotational speed of the burst rollers and decreasing the speed of the feed rollers.

12. The method as defined in claim 1 wherein the bursting of the forwardmost coupon is initiated by using a timing signal input from a signal line.

13. A method for separating coupons using feed rollers and burst rollers, wherein at least one feed roller is opposed to at least one other feed roller and at least one burst roller is opposed to said at least one other burst roller, said coupons being provided as a stream of coupons in a continuous web, wherein successive coupons are connected together by a weakened web portion extending across said web, said method comprising the steps of:

(a) advancing the continuous web along a coupon path by driving the feed rollers, said coupon path extending between the opposed feed rollers and;

(b) sensing the presence of one of said coupons at a sensing position;

(c) bowing a portion of the continuous web between the feed rollers and the burst rollers by adjusting the relative rotational speed between the feed rollers and the burst rollers such that the feed rollers are operating at a greater rotational speed than the burst rollers; and (d) bursting a coupon from said continuous web along one of said at least one weakened web portions by adjusting the relative rotational speed between the feed rollers and the burst rollers such that the burst rollers are operating at a greater rotational speed than the feed rollers.

14. The method as defined in claim 13 wherein the bowing of the portion of the continuous web between the feed rollers and the burst rollers is accomplished by changing the speed of the burst rollers to zero.

15. The method as defined in claim 14 wherein the bursting of the coupon from the web is accomplished by changing the speed of the feed rollers to zero.

16. The method as defined in claim 13 wherein the bowing of the portion of the continuous web between the feed rollers and the burst rollers is accomplished by operating the feed rollers and the burst rollers at a given speed, then increasing the speed of the feed rollers and maintaining the speed of the burst rollers.

17. The method as defined in claim 13 wherein the bowing of the portion of the continuous web between the feed rollers and the burst rollers is accomplished by operating the feed rollers and the burst rollers at a given speed, then decreasing the speed of the burst rollers and maintaining the speed of the feed rollers.

18. The method as defined in claim 13 wherein the bowing of the portion of the continuous web between the feed rollers and the burst rollers is accomplished by increasing the speed of the feed rollers and operating the feed rollers and the burst rollers at a given speed, then decreasing the speed of the burst rollers.

19. The method as defined in claim 13 wherein the bursting of the coupon from the web is accomplished by increasing the speed of the burst rollers and maintaining the speed of the feed rollers.

20. The method as defined in claim 13 wherein the bursting of the coupon from the web is accomplished by decreasing the speed of the feed rollers and maintaining the speed of the burst rollers.

21. The method as defined in claim 13 wherein the bursting of the coupon from the web is accomplished by increasing the speed of the burst rollers and decreasing the speed of the feed rollers.

* * * * *